US006215465B1

(12) United States Patent
Asakura et al.

(10) Patent No.: US 6,215,465 B1
(45) Date of Patent: Apr. 10, 2001

(54) APPARATUS AND METHOD OF DISPLAYING IMAGE BY LIQUID CRYSTAL DISPLAY DEVICE

(75) Inventors: Tsutou Asakura, Odawara; Masato Furuya, Yokosuka, both of (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 09/154,170

(22) Filed: Sep. 16, 1998

(51) Int. Cl.[7] ..... G09G 3/36
(52) U.S. Cl. ..... 345/87; 345/90; 345/96
(58) Field of Search ..... 345/87, 90, 94, 345/96, 99

(56) References Cited

U.S. PATENT DOCUMENTS 5,844,538 * 12/1998 Shiraki et al. ..... 345/87
5,907,314 * 5/1999 Negishi et al. ..... 345/103

* cited by examiner

*Primary Examiner*—Richard Hjerpe
*Assistant Examiner*—Duc Dinh
(74) *Attorney, Agent, or Firm*—Jacobson, Price, Holman & Stern, PLLC

(57) ABSTRACT

An input analog video signal is converted into digital video data. The digital video data is inverted to inverted digital video data. The digital video data and the inverted digital video data are selectively output for each one field period of the input analog video signal. The selectively output digital video data and the inverted digital video data are converted into a first and a second analog video signal. The first and second analog video signals are adjusted at different first and second bias voltage levels, respectively. The adjusted first and second analog video signals are selectively output to a liquid crystal display device for each one field period. It is preferable to output the same digital video data twice for each one field period before inversion. In this case, the digital video data and the inverted digital video data are selectively output for each ½ field period, and the adjusted first and second analog video signals are selectively output for each ½ field period.

6 Claims, 8 Drawing Sheets

APPARATUS AND METHOD OF DISPLAYING IMAGE BY LIQUID CRYSTAL DISPLAY DEVICE

BACKGROUND OF THE INVENTION

The present invention relates to a liquid crystal displaying apparatus for televisions, projectors and the like. Particularly, this invention relates to a displaying apparatus using an active matrix transmission- or reflection-type liquid crystal display device, and a method of displaying an image by the display device.

Recently, a color liquid crystal displaying apparatus has widely been used as a display for televisions, personal computers, projectors with a large screen for projecting moving pictures, and so on. Particularly, a transmission-type liquid crystal display device is applied to the televisions and personal computers. On the other hand, a reflection-type liquid crystal display device is applied to the projectors. The liquid crystal display devices are combined with a color filter to achieve a precise and distortion-free image.

Generally, the active matrix driving method is employed for a liquid crystal displaying apparatus as shown in FIG. 1. The apparatus shown in FIG. 1 includes a signal processor 1, a digital-to-analog (D/A) converter 2, an amplifier (AMP) 3, an inverter 4, an analog switch 5, a switch controller 6, an offset voltage applier 7 and a liquid crystal display device (LCD) 8.

A video signal supplied to the apparatus is subjected to digital processing by the signal processor 1 and converted into an analog signal by the D/A converter 2. The analog video signal is amplified by the amplifier 3 and inverted by the inverter 4. Either the amplified signal "a" or inverted signal "b" is selected for each field period by the switch 5 under the control of the switch controller 6. The selected signal "c" is clamped at a level by the offset voltage applier 7 and supplied to the liquid crystal display device 8.

In the apparatus shown in FIG. 1, the amplifier 3, inverter 4, switch 5 and offset voltage applier 7 are constituted by complex analog circuitry. Particularly, the offset voltage applier 7 is constituted by a damper and a complex buffer with high input impedance.

Concerning symmetry in the non-inverted video signal "a" and the inverted signal "b" in FIG. 1, highly precise gain, frequency characteristic, phase characteristic, and an offset amount are required. Those requirements are however difficult to meet by the complex circuitry, and an unevenness often occurs in the characteristics of the liquid crystal displaying apparatuses.

Furthermore, transfer of a polyphase video signal requires signal processing circuitry for each phase signal. A vertical stripe pattern noise would occur if the polyphase signal exhibits uneven characteristics. This results in an image of extremely low quality.

Accordingly, the conventional apparatus requires highly precise circuit components for securing the display precision and quality of the image. And, the analog circuit components must be adjusted accurately. These requirements results in a high manufacturing cost.

Particularly, for high-vision, the liquid crystal displaying apparatus must process the polyphase signal of eight or more phases. This results in a bulk analog circuitry.

SUMMARY OF THE INVENTION

A purpose of the present invention is to provide a liquid crystal displaying apparatus to display an image of high quality with a simple circuit configuration and a method thereof.

The present invention provides a liquid crystal displaying apparatus comprising: a first converter to convert an input analog video signal into digital video data; an inverter to invert the digital video data to inverted digital video data; a first selector to selectively output the digital video data and the inverted digital video data at most for each specific period of time; a second converter to convert the selectively output digital video data and the inverted digital video data into a first and a second analog video signal; means for adjusting the first and second analog video signals at different first and second bias voltage levels, respectively; a second selector to selectively output the adjusted first and second analog video signals at most for each of the specific period of time; and a liquid crystal display device to display an image in response to the selectively output first and second analog video signals.

Furthermore, the present invention provides a liquid crystal image displaying apparatus for displaying an image carried by a polyphase video signal including the first to N-th phase video signals (N being an integer of two or more), the apparatus comprising: a converter to convert the first to N-th phase video signals into first to N-th digital video data, respectively; an inverter to invert each digital video data to inverted video data corresponding to each digital video data; a first selector to selectively output each digital video data and the inverted data corresponding to each digital video data for each specific period of time; a second converter to convert the selectively output each digital video data into first analog signals and the inverted video data corresponding to each digital video data into second analog video signals; means for adjusting the first and second analog video signals at different first and second bias voltage levels, respectively; a second selectors to selectively output the adjusted first and second analog video signals for each of the specific period of time; and a liquid crystal display device to display the image in response to the selectively output first and second analog video signals.

Furthermore, the present invention provides a method of supplying a video signal to a liquid crystal displaying apparatus, comprising the steps of: converting an input analog video signal into digital video data; inverting the digital video data to inverted digital video data; selectively outputting the digital video data and the inverted digital video data at most for each specific period of time; converting the selectively output digital video data and the inverted digital video data into a first and a second analog video signal; adjusting the first and second analog video signals at different first and second bias voltage levels, respectively; selectively outputting the adjusted first and second analog video signals at most for each of the specific period of time to the liquid crystal display device.

DETAILED DESCRIPTION OF PREFERRED EMBODIMENTS

Preferred embodiments according to the present invention will be described with reference to the attached drawings.

Figure 2:
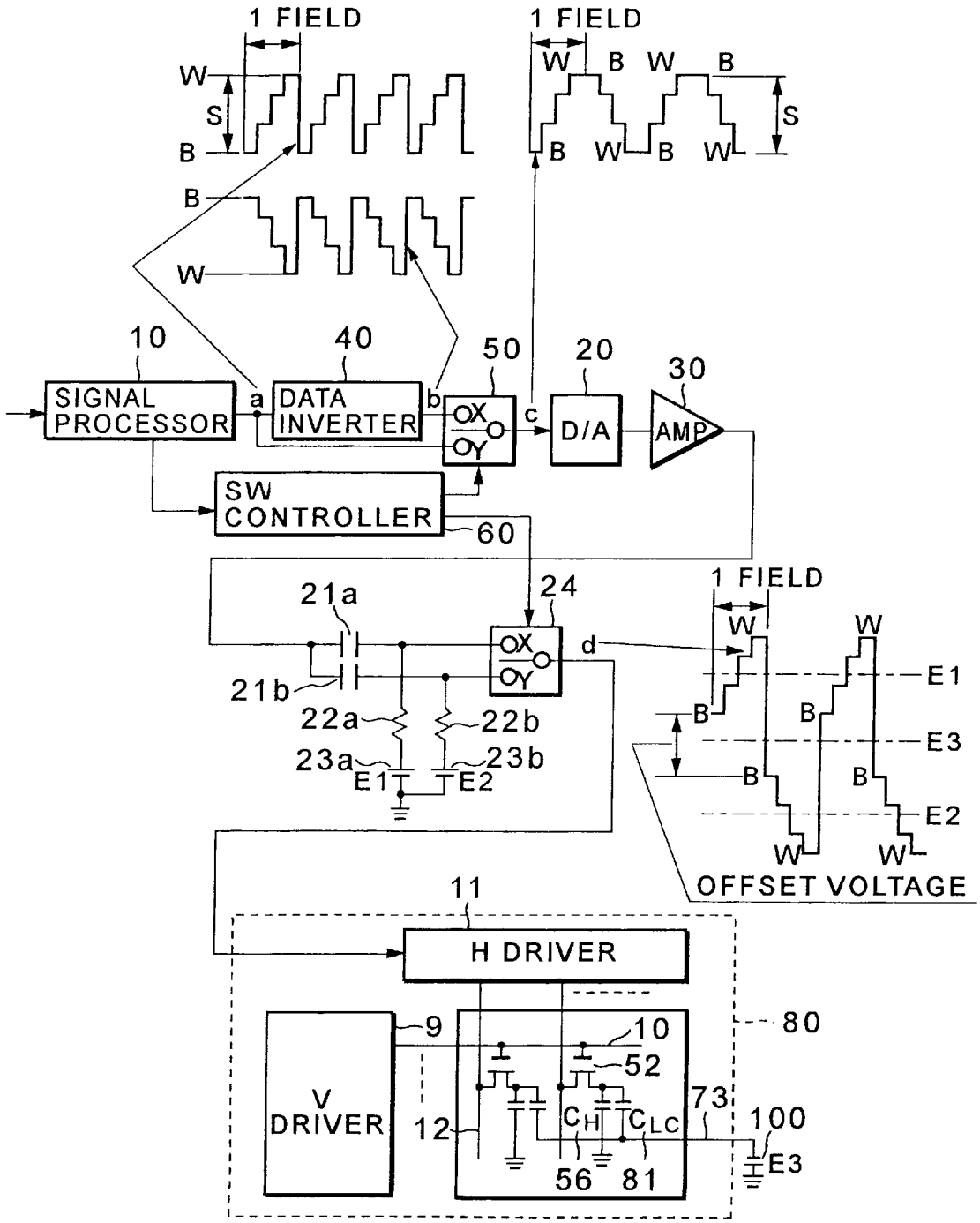
FIG. 2 is a block diagram of the first preferred embodiment of a liquid crystal displaying apparatus according to the present invention.

FIG. 2 show the first embodiment of a liquid crystal displaying apparatus according to the present invention.

The liquid crystal displaying apparatus shown in FIG. 2 includes a signal processor 10, a data inverter 40, a digital switch 50, a digital-to-analog (D/A) converter 20, an amplifier (AMP) 30, a switch controller 60, an analog switch 24 and a reflection-type active-matrix liquid crystal displaying device 80.

The amplifier 30 is connected to the analog switch 24 via two parallel coupling capacitors 21*a* and 21*b*.

The coupling capacitor 21*a* is connected to a bias circuit constituted by a resistor 22*a* and a direct current (DC) bias power supply 23*a* (DC voltage E1). The coupling capacitor 21*b* is connected to another bias circuit constituted by a resistor 22*b* and a DC bias power supply 23*b* (DC voltage E2).

Figure 1:
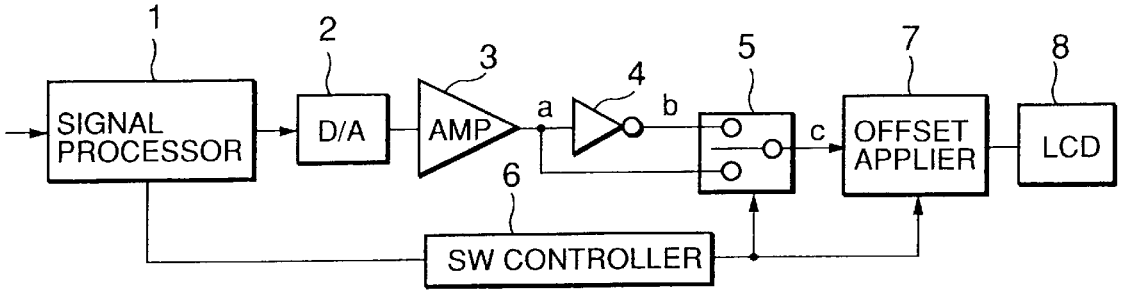
FIG. 1 is a block diagram of a conventional liquid crystal displaying apparatus.
Figure 3:
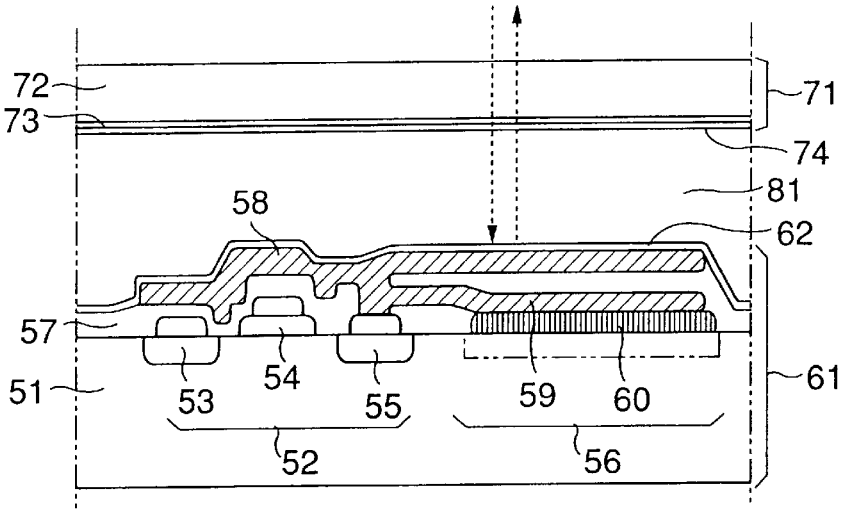
FIG. 3 is a sectional view illustrating the configuration of a liquid crystal display device for one pixel according to the first embodiment.

One pixel portion on a display area of the liquid crystal display device 80 is shown in FIG. 3. A plurality of such pixel portions are arranged in a matrix to constitute a display panel.

In FIG. 3, formed on an silicon substrate 51 are an MOSFET 52 (switching device) having a source 53, a gate 54 and a drain 55, and a capacitor 56 for storing electric charge corresponding to one pixel. These elements are covered with an insulator layer 57.

An aluminum pixel electrode (reflection electrode) 58 is formed on the insulator layer 57. A lower portion of the pixel electrode 58 is connected to the drain 55 of the MOSFET 52. A conductor 59 extends sideways from the connecting portion. An $SiO_2$ dielectric film 60 is intervened between the conductor 59 and the substrate 51. This lamination constitutes the capacitor 56.

The MOSFET 52, the capacitor 56, the pixel electrode 58, and the substrate 51 on which these elements are formed constitute an active element substrate 61 for one pixel. A liquid crystal orientation film 62 is formed on the active element substrate 61.

A transparent substrate 71 is provided to face the active element substrate 61. The transparent substrate 71 is constituted by a glass substrate 72 and a transparent common electrode film 73 formed thereon. A direct current power supply 100 is connected to the transparent common electrode film 73 as shown in FIG. 2. A liquid crystal orientation film 74 is formed on the transparent substrate 71.

A liquid crystal layer 81 is sandwiched and sealed between the active element substrate 61 and the transparent substrate 71 via the liquid crystal orientation films 62 and 74.

The operation of the liquid crystal display 80 shown in FIG. 2 is described. FIG. 2 shows only two MOSFETs 52 and also only two capacitors 56 for brevity. Actually, a number of them are arranged in a matrix like shown in FIG. 7 which will be described later.

A vertical scanning (selection) signal is supplied from a vertical (V) driver 9 to the gate 54 of MOSFETs 52 through a gate line 10 to turn on the selected MOSFETs 52.

Furthermore, a video signal is supplied from a horizontal (H) driver 11 to the sources 53 of the MOSFETs 52 through signal lines 12. The video signal is supplied to the pixel electrode 58 via the drain 55 (FIG. 3). The capacitor 56 stores electric charges carried by the video signal via the conductor 59.

Accordingly, even if supply of the selection signal on the gate line 10 is terminated, the electric charge carried by the video signal for one pixel is kept stored in the capacitor 56. And, the pixel electrode 58 is held at a potential for a period of time (time constant) decided by the discharge resistance and the total capacitance of the capacitance $C_H$ corresponding to the video signal for one pixel and the capacitance $C_{LC}$ of the liquid crystal layer 81. The time constant is set to be longer than a field period of the video signal.

During that period of time, a voltage generated across the pixel electrode 58 and the common electrode film 73 is applied to the liquid crystal layer 81 to vary the light transmittance of liquid crystals. Control of the voltage by the video signal supplied on the signal line 12 thus provides modulation of light which enters the liquid crystal layer 81 via the glass substrate 72, is reflected by the reflection electrode layer 58, and is emitted from the glass substrate 72.

In detail, the selection signal is supplied on the gate line 10 to turn on all the MOSFETs 52 connected to the gate line 10. And, the video signal is supplied to the turned-on MOSFETs 52 through the signal lines 12 to charge the capacitor 56 connected thereto. This operation is performed in a horizontal and a vertical direction over the pixel matrix to modulate incident read light for each pixel, thus outputting reflected modulated light.

A video signal is supplied to the liquid crystal display device 80 through the following processing.

An analog video signal supplied to the signal processor 10 is converted into digital video data "a". The digital video data "a" is then inverted by the data inverter 40. The digital video data "a" and the inverted digital video data "b" are selectively supplied to the D/A converter 20 via the digital switch 50 for each one field period of the video signal. The switch 50 is controlled by the switch controller 60 in accordance with a vertical scanning signal supplied from the signal processor 10.

The digital video data "c" is converted into an analog video signal by the D/A converter 20 and amplified by the amplifier 30.

The output of the amplifier 30 is divided into two signals via the coupling capacitors 21*a* and 21*b* and adjusted at different voltage levels by the two bias circuits. The divided signals are then supplied to the analog switch 24. The analog switch 24 is also controlled by the switch controller 60 for each one field period to selectively output the divided signals to the H driver 11 of the liquid crystal display device 80.

More in detail, the digital video data "a" output from the signal processor 10 is divided into two signals. One is inverted by the data inverter 40 and supplied to the digital switch 50 as the digital video data "b". The other is supplied to the digital switch 50 as it is, as the digital video data "a".

The digital switch 50 alternatively outputs the non-inverted video data "a" and the inverted video data "b" for each one field period under the control of the switch controller 60. Video data "c" is then output by the digital switch 50, which is sequential data of non-inverted and inverted field video data.

The video data is represented by, for example, 256 gradation with eight bits in the range of white (W) to black (B) level. The non-inverted video data "a", the inverted video data "b", and the output video data "c" are illustrated in (A), (B) and (C), respectively, of FIG. 4.

Figure 4:
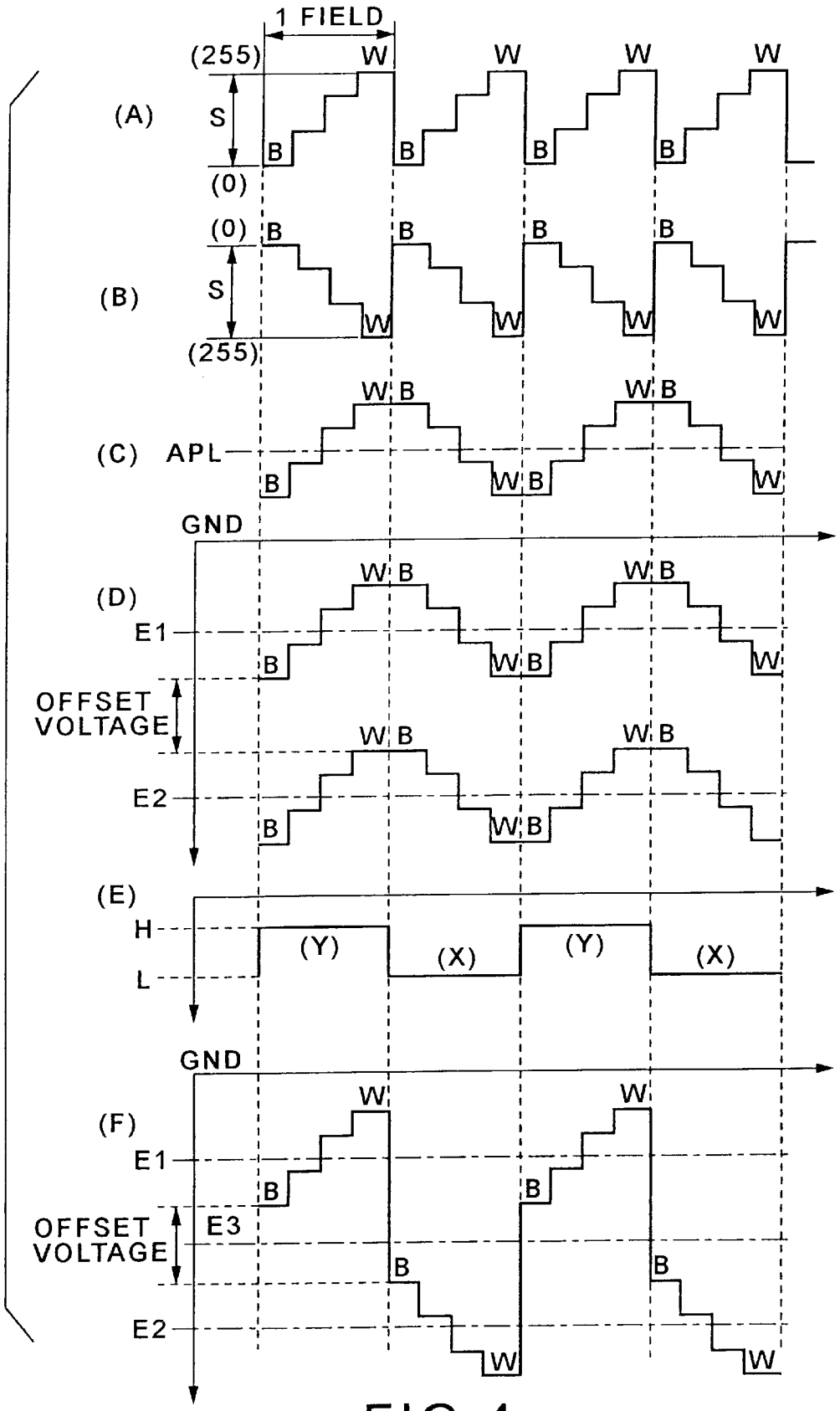
FIG. 4 is a timing chart for explaining the operation of the liquid crystal displaying apparatus according to the first embodiment.

The switching operation of the digital switch 50 is performed in synchronism with output pulses, as shown in (E) of FIG. 4, of the switch controller 60. The digital switch 50 selects the non-inverted video data "a" via its contact point Y when the output pulses are at high level (H). On the other hand, the digital switch 50 selects the inverted video data "b" via its contact point X when the output pulses are at low level (L).

The digital video data "c" output by the digital switch 50 is converted into an analog video signal by the D/A converter 20. The analog video signal is divided into two signals after amplified by the amplifier 30. The divided analog signals pass through the coupling capacitors 21*a* and 21*b* to eliminate DC components from the signals.

The divided analog signals have the same waveform and are sequential signals each constituted by video signals which are inverted and non-inverted for each one field with high coloration between fields.

The video signal after DC component elimination thus has an average level (APL) as the center level, shown in (C) of FIG. 4, which is always almost zero without respect to what data the video signal carries.

The analog video signals after passing through the coupling capacitors 21*a* and 21*b* are adjusted at different voltage levels by the two bias circuits. In detail, the DC bias power supplies 23*a* and 23*b* supply DC voltages E1 and E2 to the analog video signals via the resistors 22*a* and 22*b*, respectively.

Application of the voltages E1 and E2 shift the center level APL, shown in (C) of FIG. 4, of each analog video signal according to the voltage level. The voltages E1 and E2 are set so that, as shown in (D) of FIG. 4, a difference (offset voltage) between the minimum level of the analog video signal to which the voltage E1 is applied and the maximum level of the other analog video signal to which the voltage E2 is applied is grater than an operating threshold level of the liquid crystals of the liquid crystal display device 80.

The analog video signals are then selected by the analog switch 24. In detail, the analog video signal with the center level E1, shown in (D) of FIG. 4, is selected when the output pulses from the switch controller 60 are at high level. On the other hand, the other analog video signal with the center level E2, shown in (D) of FIG. 4, is selected when the output pulses from the switch controller 60 are at low level.

The analog signal, shown in (F) of FIG. 4, is therefore output from the analog switch 24. The signal, shown in (F) of FIG. 4, contains video signals inverted and non-inverted for each one field with the offset voltage grater than the operating threshold level of the liquid crystals.

Here, the switching timing for both the digital switch 50 and the analog switch 24 is one field period of the input analog video signal. This is because video signals have strong coloration between fields of the video signals.

The analog signal, shown in (F) of FIG. 4, is then supplied to the H driver 11 of the liquid crystal display device 80 to drive the liquid crystals for each one field.

As shown in (F) of FIG. 4, the DC voltage E3 supplied from the DC power supply 100 to the common electrode film 73 is set at an intermediate level between the voltages E1 and E2 (offset voltage).

The second embodiment of a liquid crystal video displaying apparatus according to the present invention will be described with reference to FIGS. 5 and 7. Elements in this embodiment that are the same as or analogous to elements in the first embodiments are referenced by the same reference numerals and will not be explained in detail.

The second embodiment is basically the same as the first embodiment but processes a polyphase video signal.

Figure 5:
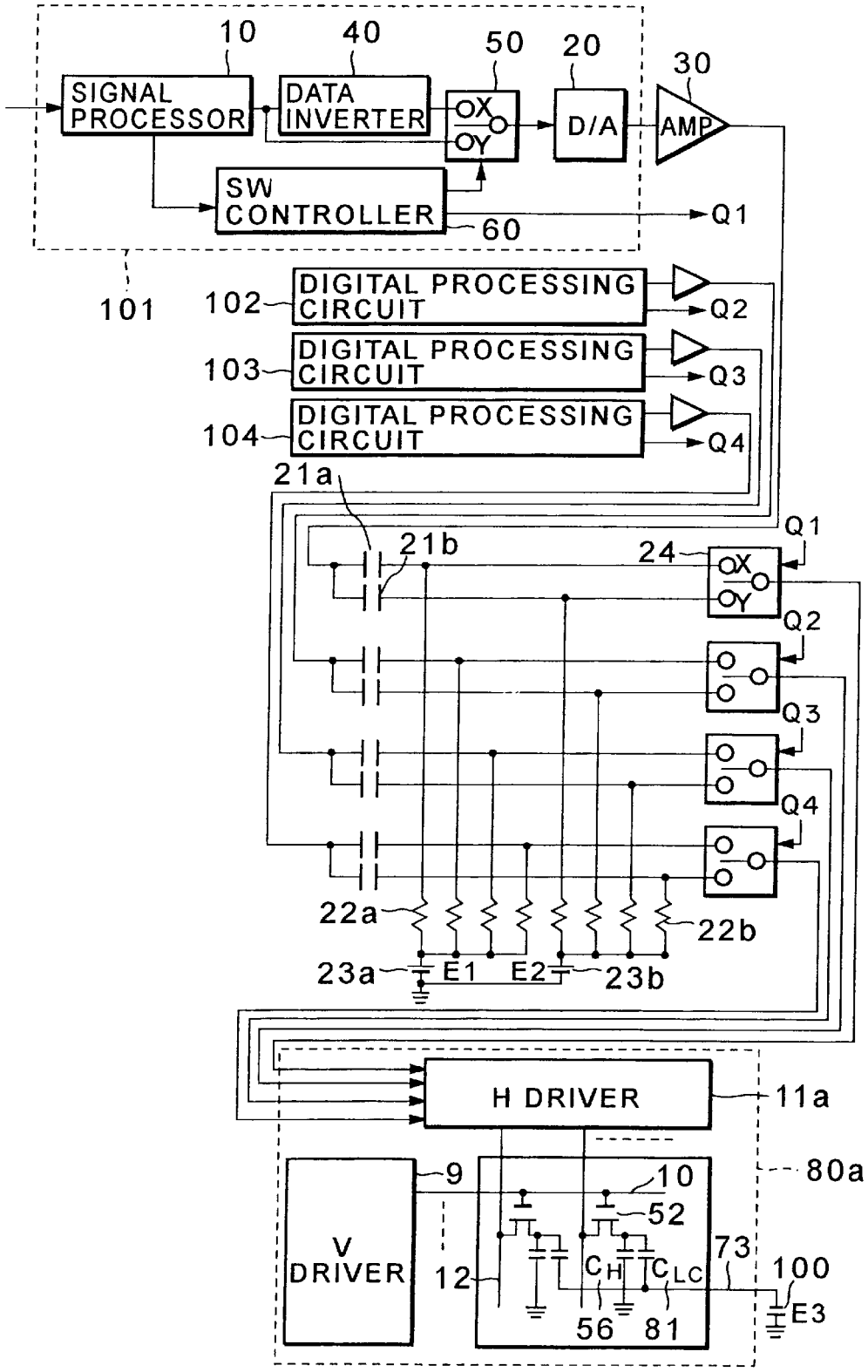
FIG. 5 is a block diagram of the second preferred embodiment of a liquid crystal displaying apparatus according to the present invention.

The liquid crystal displaying apparatus shown in FIG. 5 includes four digital processing circuits 101 to 104 for processing video signals of four phases. In detail, the four digital processing circuits processes the first- to fourth-phase signals shifted by three pixels each other in the horizontal scanning direction and four pixels each other in the horizontal scanning direction.

Each digital processing circuit includes the digital processor 10, the data inverter 40, the digital switch 50, the digital-to-analog converter 20, and the switch controller 60 shown in FIG. 2. The four digital processing circuits can be contained in one IC chip.

Connected to each digital processing circuit are the amplifier 30, the coupling capacitors 21*a* and 21*b*, the resistors 22*a* and 22*b*, and the analog switch 24. On the other hand, only one power supply 23*a* is connected to the four resistors 22*a*, and also only one power supply 23*b* is connected to the four resistors 22*b*. The eight resistors 22*a* and 22*b* can be formed in ladder resistors sealed into one package with a small resistance variation.

Figure 6:
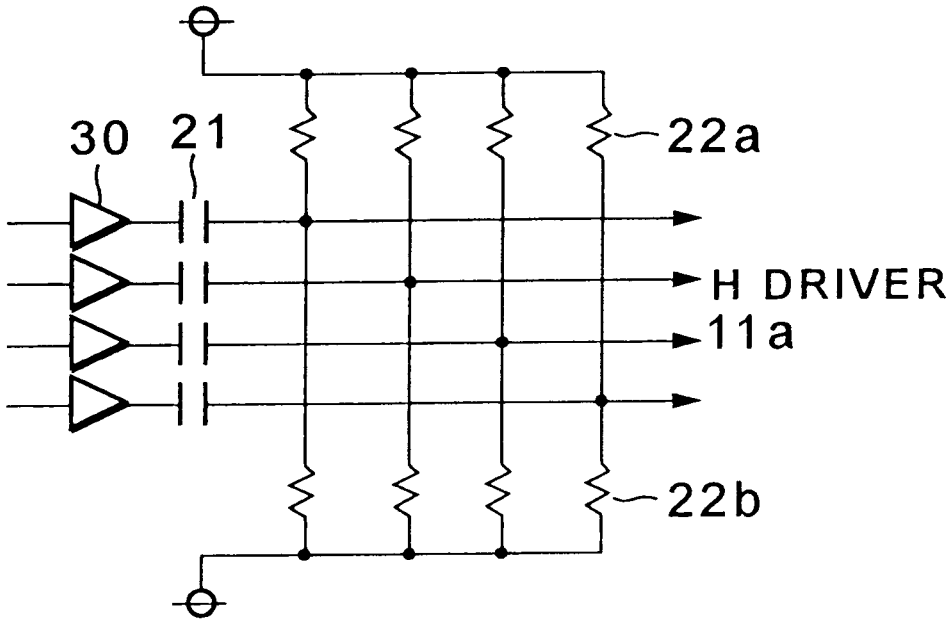
FIG. 6 shows a bias circuit applicable to liquid crystal displaying apparatus according to the present invention.

The power supplies 23*a* and 23*b* can be omitted by constituting the bias circuits as shown in FIG. 6 where the resistors 22*a* and 22*b* are connected to a power supply (not shown) for driving the liquid crystal displaying apparatus shown in FIG. 5. FIG. 6 shows the two capacitors 21*a* and 21*b* as one capacitor 21 for brevity.

Figure 7:
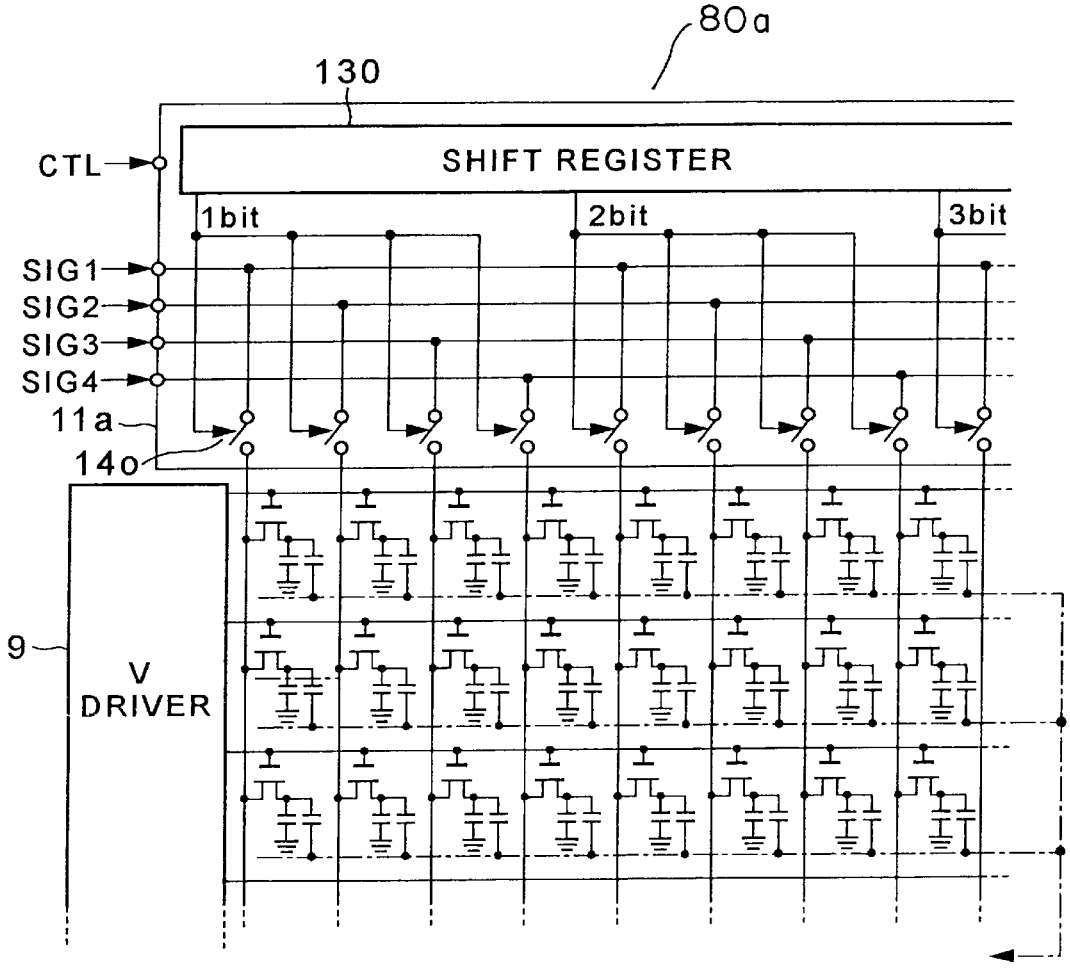
FIG. 7 shows a circuit configuration of a liquid crystal display device according to the second embodiment.

The detailed configuration of a liquid crystal display device 80*a* is shown in FIG. 7 for displaying the video signals of four phases.

The first- to fourth-phase video signals SIG1 to SIG4 are supplied from the analog switch 24 to an H driver 11*a* being subjected to the same processing as those described in the first embodiment by the digital processing circuits 101 to 104, amplifier 30, coupling capacitors 21*a* and 21*b* and the bias circuits. Four switches 140 are simultaneously controlled by a shift register 130 which is constituted for the number of bits corresponding to ¼ of the number of pixels in the horizontal direction. This operation charges capacitors 56 (FIG. 5) with electric charges carried by the video signals SIG1 to SIG4 simultaneously for four pixels.

The driving frequency for the liquid crystal display device in FIG. 5 can be lowered to ¼ of that for the liquid crystal display device in FIG. 2. And, hence the second embodiment is applicable to a liquid crystal displaying apparatus with a large number of pixels.

Figure 8:
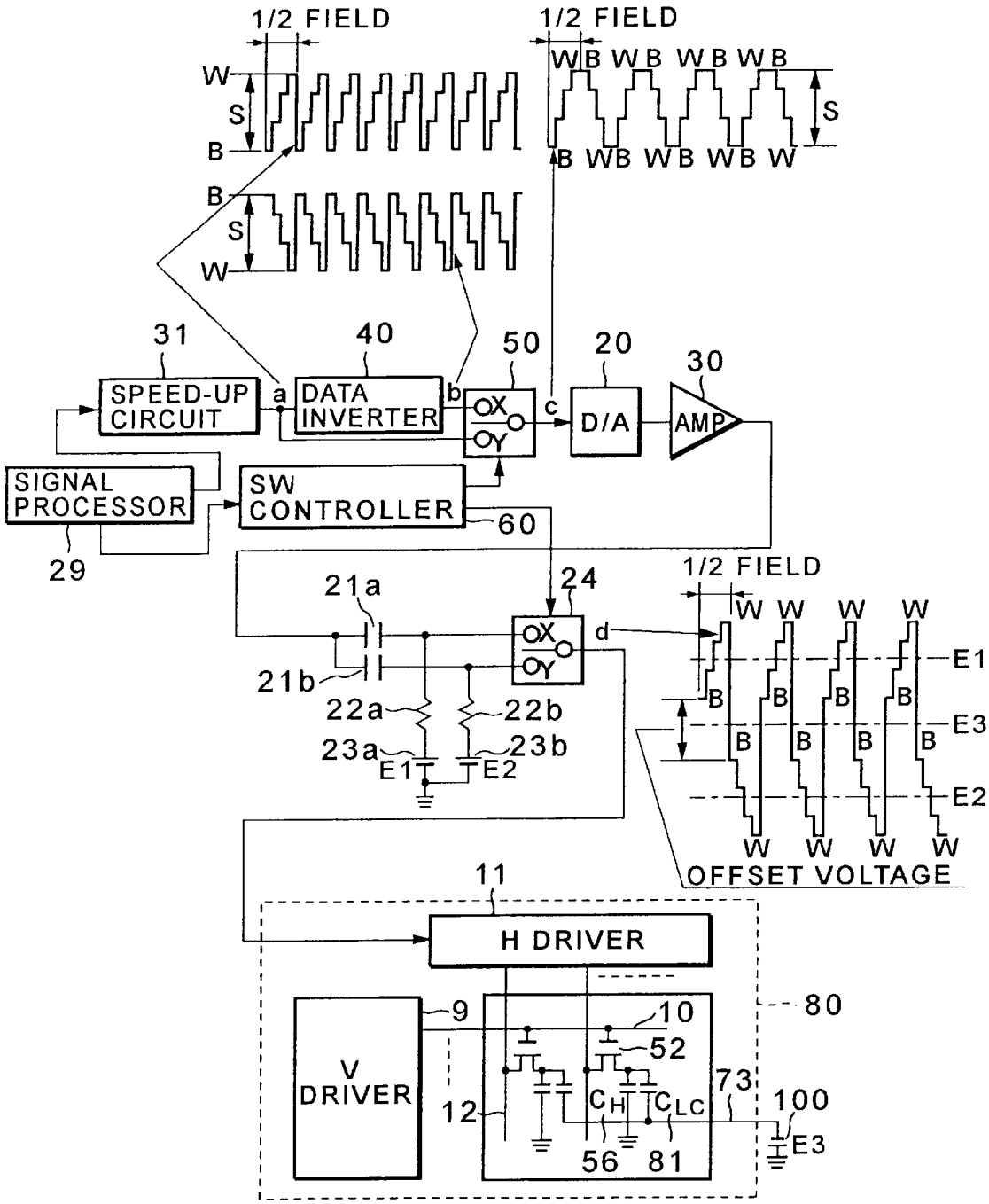
FIG. 8 is a block diagram of the third preferred embodiment of a liquid crystal displaying apparatus according to the present invention.

The third embodiment of a liquid crystal displaying apparatus according to the present invention will be described with reference to FIG. 8. Elements in this embodiment that are the same as or analogous to elements in the first embodiments are referenced by the same reference numerals.

The third embodiment includes a signal processor 29 and a speed-up circuit 31 in addition to those shown in FIG. 2.

When an analog video signal is supplied, the signal processor 29 outputs digital field video data for a period of time shorter than a ½ field period for displaying. The processing speed of the signal processor 29 is thus higher than that of the signal processor 10 shown in FIG. 2 that outputs field video data for each one field period.

The speed-up circuit 31 has a field memory and is provided between the signal processor 29 and the data inverter 40. The field memory stores each field video data whenever it is supplied from the signal processor 29. The speed-up circuit 31 outputs the same field video data twice for one field period and accepts the next field video data.

In other words, whenever the signal processor 29 outputs field video data, the speed-up circuit 31 (field memory) stores the field video data and outputs the data for the ½ field period, that is, the same data twice for one field period.

Figure 9:
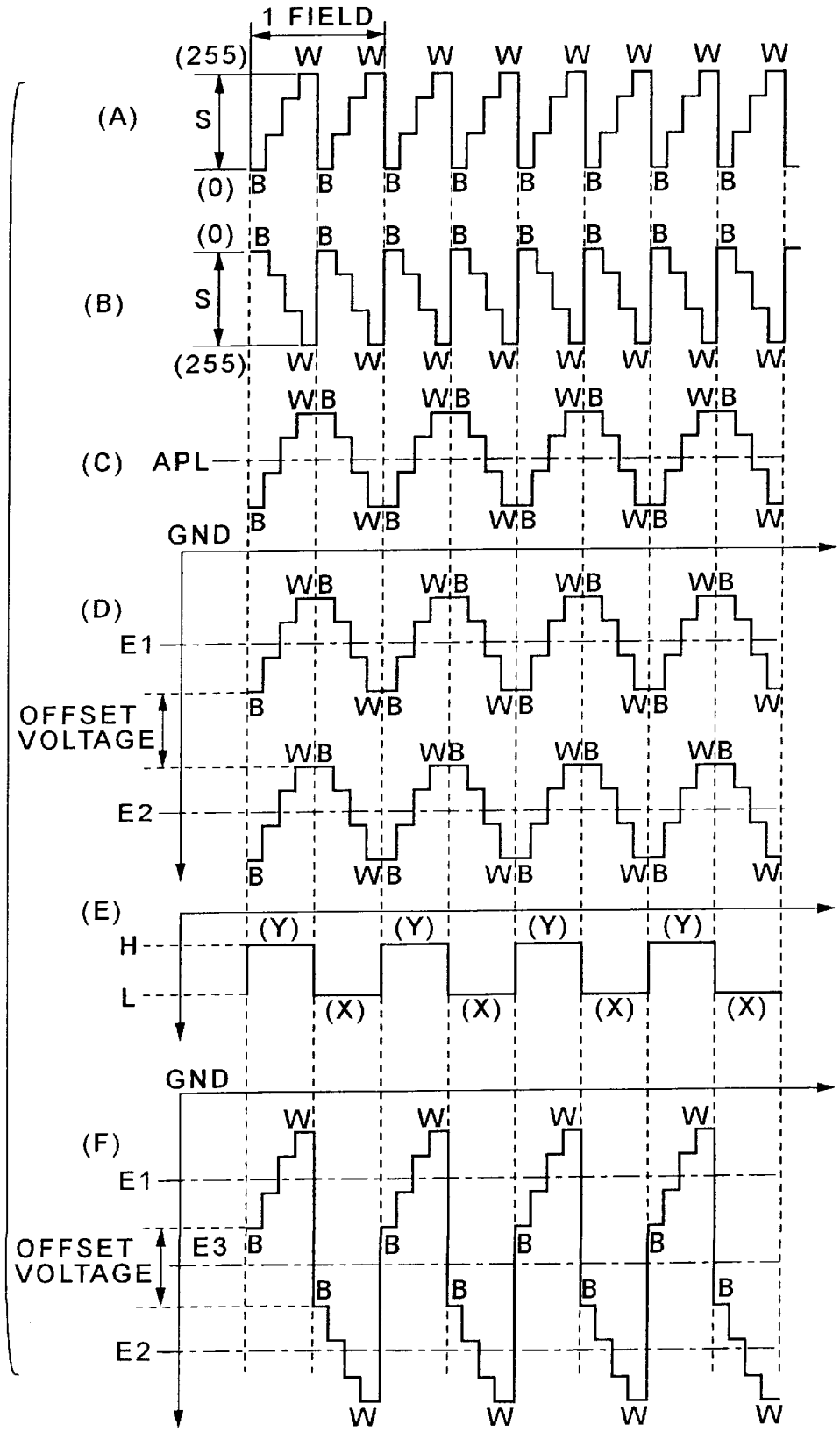
FIG. 9 is a timing chart for explaining the operation of the liquid crystal displaying apparatus according to the third embodiment.

The digital switch 50 is controlled for the ½ field period by the switch controller 60 so that the output of the switch 50 is switched between non-inverted video data "a" from the speed-up circuit 31, as shown in (A) of FIG. 9, and inverted video data "b" from the data inverter 40 as shown in (B) of FIG. 9.

The digital video data "c", shown in (C) of FIG. 9, is converted into an analog video signal by the D/A converter 20 and amplified by the amplifier 30.

The output of the amplifier 30 is divided into two signals via the coupling capacitors 21*a* and 21*b* and adjusted at different voltage levels by the two bias circuits. The divided signals are then supplied to the analog switch 24. The analog switch 24 is also controlled by the switch controller 60 for each ½ field period to selectively output the divided signals to the H driver 11 of the liquid crystal display device 80.

More in detail, the digital video data "a" output from the speed-up circuit 31 is divided into two signals. One is inverted by the data inverter 40 and supplied to the digital switch 50. The other is supplied to the digital switch 50 as it is.

The digital switch 50 alternatively outputs the non-inverted video data "a" and the inverted video data "b" for each ½ field period under the control of the switch controller 60. Video data "c" is then output by the digital switch 50, which is sequential data of non-inverted and inverted field video data.

The video data is represented by, for example, 256 gradation with eight bits in the range of white (W) to black (B) level like the first embodiment. The non inverted video data "a", the inverted video data "b", and the output video data "c" are illustrated in (A), (B) and (C), respectively, of FIG. 9.

The switching operation of the digital switch 50 is performed in synchronism with output pulses, as shown in (E) of FIG. 9, of the switch controller 60. The digital switch 50 selects the non-inverted video data "a" via its contact point Y when the output pulses are at high level (H). On the other hand, the digital switch 50 selects the inverted video data "b" via its contact point X when the output pulses are at low level (L).

The digital video data "c" output by the digital switch 50 is converted into an analog video signal by the D/A converter 20. The analog video signal is divided into two signals after amplified by the amplifier 30. The divided analog signals pass through the coupling capacitors 21*a* and 21*b* to eliminate DC components from the signals.

The divided analog signals have the same waveform and are sequential signals each constituted by video signals which are inverted and non-inverted for each ½ field with high coloration between fields.

The video signal after DC component elimination thus has an average level (APL) as the center level, shown in (C) of FIG. 9, which is always almost zero without respect to what data the video signal carries.

The analog video signals after passing through the coupling capacitors 21*a* and 21*b* are adjusted at different voltage levels by the two bias circuits. In detail, the DC bias power supplies 23*a* and 23*b* supply DC voltages E1 and E2 to the analog video signals via the resistors 22*a* and 22*b*, respectively.

Application of the voltages E1 and E2 shift the center level APL, shown in (C) of FIG. 9, of each analog video signal according to the voltage level. The voltages E1 and E2 are set so that, as shown in (D) of FIG. 9, a difference (offset voltage) between the minimum level of the analog video signal to which the voltage E1 is applied and the maximum level of the other analog video signal to which the voltage E2 is applied is grater than an operating threshold level of the liquid crystals of the liquid crystal display device 80.

As shown in (C) of FIG. 9, each field image with the average level APL as the center level has a complete symmetrical waveform within one field period, thus providing an accurate offset voltage setting by the bias circuits.

The analog video signals are then selected by the analog switch 24. In detail, the analog video signal with the center level E1, shown in (D) of FIG. 9, is selected when the output pulses from the switch controller 60 are at high level. On the other hand, the other analog video signal with the center level E2, shown in (D) of FIG. 9, is selected when the output pulses from the switch controller 60 are at low level.

The analog signal, shown in (F) of FIG. 9, is therefore output from the analog switch 24. The signal, shown in (F) of FIG. 9, contains video signals inverted and non-inverted for each ½ field period with the offset voltage grater than the operating threshold level of the liquid crystals.

The analog signal, shown in (F) of FIG. 9, is then supplied to the H driver 11 of the liquid crystal display device 80 to drive the liquid crystals for each ½ field period.

As shown in (F) of FIG. 9, the DC voltage E3 supplied from the DC power supply 100 to the common electrode film 73 is set at an intermediate level between the voltages E1 and E2 (offset voltage).

The third embodiment provides a video signal of a complete symmetrical waveform for one field period for driving the liquid crystals, thus generating no flicker.

The third embodiment is also applicable to a polyphase signal. In this case, the same as that shown in FIG. 5, digital processing circuits each including the signal processor 29, the speed-up circuit 31, the data inverter 40, the digital switch 50, the digital-to-analog converter 20, and the switch controller 60 are provided. The number of the digital processing circuits depends on the number of signals included in the polyphase video signal.

As described above, according to the present invention, a video signal is supplied to a liquid crystal display device as follows:

An input analog video signal is converted into digital video data. The digital video data is inverted to inverted digital video data. The digital video data and the inverted digital video data are selectively output for each specific period of time, such as, one field period of the input analog video signal.

The selectively output digital video data and the inverted digital video data are converted into a first and a second analog video signal. The first and second analog video signals are adjusted at different first and second bias voltage levels, respectively. The adjusted first and second analog video signals are selectively output to the liquid crystal display device for each of the specific period of time.

As described, the digital video data is inverted before converted into analog video data, thus the present invention provides an inverted digital video signal of high quality.

It is preferable to output the same digital video data twice for each one field period before inversion. In this case, the digital video data and the inverted digital video data are selectively output for each half of one field period, and the adjusted first and second analog video signals are selectively output for each half of one field period.

The outputting twice the same video signals serves to achieve a complete symmetrical waveform of the video signals for one field period, thus generating no flicker on a displayed image.

What is claimed is:

1. A liquid crystal displaying apparatus comprising:

a first converter to convert an input analog video signal into digital video data;

an inverter to invert the digital video data to inverted digital video data;

a first selector to selectively output the digital video data and the inverted digital video data at most for each specific period of time;

a second converter to convert the selectively output digital video data and the inverted digital video data into a first and a second analog video signal;

means for adjusting the first and second analog video signals at different first and second bias voltage levels, respectively;

a second selector to selectively output the adjusted first and second analog video signals at most for each of the specific period of time; and a liquid crystal display device to display an image in response to the selectively output first and second analog video signals.

2. The apparatus according to claim 1 further comprising means for eliminating direct current components from the first and second analog video signals before the first and second analog video signals are adjusted by the adjusting means.

3. The apparatus according to claim 1 further comprising means for accepting the digital video data output by the first converter and outputting the digital video data at least twice for each of the specific period of time, the first selector selectively outputting the digital video data and the inverted digital video data for each half of the specific period of time, and the second selector selectively outputting the adjusted first and second analog video signals for each half of the specific period of time.

4. The apparatus according to claim 1, wherein a level difference between the first and second bias voltage levels is higher than an operating threshold voltage level of the liquid crystal display device.

5. The apparatus according to claim 1, wherein the specific period of time is one field period of the input analog video signal.

6. A liquid crystal image displaying apparatus for displaying an image carried by a polyphase video signal including the first to N-th phase video signals (N being an integer of two or more), the apparatus comprising:

a converter to convert the first to N-th phase video signals into first to N-th digital video data, respectively;

an inverter to invert each digital video data to inverted video data corresponding to each digital video data;

a first selector to selectively output each digital video data and the inverted data corresponding to each digital video data for each specific period of time;

a second converter to convert the selectively output each digital video data into first analog signals and the inverted video data corresponding to each digital video data into second analog video signals;

means for adjusting the first and second analog video signals at different first and second bias voltage levels, respectively;

a second selectors to selectively output the adjusted first and second analog video signals for each of the specific period of time; and a liquid crystal display device to display the image in response to the selectively output first and second analog video signals.

* * * * *